US008132413B2

(12) United States Patent
Oser et al.

(10) Patent No.: US 8,132,413 B2
(45) Date of Patent: Mar. 13, 2012

(54) METHOD OF TRANSFORMING HEAT ENERGY TO MECHANICAL ENERGY IN A LOW-PRESSURE EXPANSION DEVICE

(75) Inventors: Erwin Oser, Cologne (DE); Michael Rannow, Lennestadt (DE)

(73) Assignee: Ecoenergy Patent GmbH, Darmstadt (DE)

( * ) Notice: Subject to any disclaimer, the term of this patent is extended or adjusted under 35 U.S.C. 154(b) by 0 days.

(21) Appl. No.: 10/583,925

(22) PCT Filed: Dec. 22, 2004 (Under 37 CFR 1.47)

(86) PCT No.: PCT/EP2004/053654

§ 371 (c)(1), (2), (4) Date: Aug. 10, 2007

(87) PCT Pub. No.: WO2005/061858

PCT Pub. Date: Jul. 7, 2005

(65) Prior Publication Data

US 2008/0134680 A1 Jun. 12, 2008

(30) Foreign Application Priority Data

| | | |
|---|---|---|
| Dec. 22, 2003 | (DE) | 103 60 364 |
| Dec. 22, 2003 | (DE) | 103 60 379 |
| Dec. 22, 2003 | (DE) | 103 60 380 |
| Dec. 24, 2003 | (DE) | 103 61 203 |
| Dec. 24, 2003 | (DE) | 103 61 223 |

(51) Int. Cl.
*F01K 25/08* (2006.01)

(52) U.S. Cl. ..... 60/651; 60/671

(58) Field of Classification Search ..... 60/651, 60/671

See application file for complete search history.

(56) References Cited

U.S. PATENT DOCUMENTS

| | | | | |
|---|---|---|---|---|
| 3,972,195 | A * | 8/1976 | Hays et al. | 60/671 |
| 4,429,661 | A * | 2/1984 | McClure | 122/20 B |
| 4,709,682 | A | 12/1987 | Kato | |
| 5,027,602 | A * | 7/1991 | Glen et al. | 60/651 |
| 6,817,185 | B2 * | 11/2004 | Coney et al. | 60/772 |
| 7,028,476 | B2 * | 4/2006 | Proeschel | 60/616 |
| 2003/0172654 | A1 | 9/2003 | Lawheed | |

FOREIGN PATENT DOCUMENTS

| | | |
|---|---|---|
| DE | 36 19 547 | 12/1987 |
| GB | 1 301 214 | 12/1972 |
| WO | WO 85/02881 | 7/1985 |

OTHER PUBLICATIONS

International Preliminary Report on Patentability International Application No. PCT/EP2004/053654.

Roots type supercharger pp. 1-4 http://en.wikipedia.org/w/index.php?title=Roots_type_supercharger&printable=yes.

* cited by examiner

*Primary Examiner* — Hoang Nguyen
(74) *Attorney, Agent, or Firm* — Cozen O'Connor

(57) ABSTRACT

A method of converting heat energy generated in an evaporator to mechanical energy by expanding an evaporated working fluid includes evaporating the working fluid in the evaporator and expanding the evaporated working fluid in an expansion device. The expansion is in a low-pressure expansion device which is formed as a roots blower in which the working fluid is expanded and heat energy is converted to mechanical energy.

18 Claims, 1 Drawing Sheet

METHOD OF TRANSFORMING HEAT ENERGY TO MECHANICAL ENERGY IN A LOW-PRESSURE EXPANSION DEVICE

PRIORITY CLAIM

This is a U.S. national stage of application No. PCT/EP2004/053654, filed on 22 Dec. 2004. Priority is claimed on the following application(s): Country: Germany, Application No.: 103 60 380.8, Filed: 22 Dec. 2003; Country: Germany, Application No.: 103 60 379.4, Filed: 22 Dec. 2003; Country: Germany, Application No.: 103 60 364.6, Filed: 22 Dec. 2003; Country: Germany, Application No.: 103 61 203.3, Filed: 24 Dec. 2003; and Country: Germany, Application No.: 103 61 223.8, Filed: 24 Dec. 2003, the contents of which are incorporated here by reference.

BACKGROUND OF THE INVENTION

The present invention relates to a method of transforming heat energy generated in an evaporator to mechanical energy by expanding an evaporated working fluid which is evaporated in the evaporator and expanded in the expansion device. The present invention also relates to an expansion device for transforming heat energy to mechanical energy.

A great number of methods and apparatus for transforming heat energy to mechanical energy are known from the state of the art. For example, heat engines are known, in which a working fluid is heated isobarically in a boiler under high pressures, then evaporated and subsequently super heated in a superheater. Subsequently the vapor is adiabatically expanded in a turbine where it does work and condensed in a condenser where it gives off heat. The liquid, usually water, is pressurized by a feed-water pump and recycled into the boiler. One of the drawbacks of this device is that during the expansion processes in turbines high pressures of more than 15 to 200 bar have to be generated since in turbines the pressure ratio of the expansion is essential for the efficiency to be reached. This is the main reason that in large expansion turbines the vapor is expanded into a vacuum whereby the condensation occurs at relatively low temperatures around 40° C. The condensation heat created during condensation is dissipated by means of cooling systems in a heat exchange process. This condensation heat, dissipated as waste heat, is essential in determining the efficiency to be achieved in thermal expansion processes with turbines.

Prior art transformation systems with organic solvents as working fluids (ORC systems, Organic Rankine Cycle) or the Kalina process with a mixture of water and ammonia are also based on the above vapor energy process using vaporization and condensation; they are only technical modifications so that either lower temperature or pressure levels can be used and/or to increase the efficiency by means of a better heat utilization in the boiling range.

SUMMARY OF THE INVENTION

It is therefore an object of the present invention to create a method and an apparatus for converting heat energy to mechanical energy while avoiding the above drawbacks and achieving, in particular, an improved efficiency.

The object is met by a method of converting heat energy generated in an evaporator to mechanical energy in which a working fluid is evaporated in the evaporator and expanded in a low-pressure expansion device, wherein the low-pressure expansion device is a roots blower arranged and dimensioned such that the working fluid is expanded therein and heat energy is transformed to mechanical energy.

It is provided according to the present invention that the expansion device is designed as a low-pressure expansion device which is formed as a roots blower (roots pump/roots rotary positive blower) in which the working fluid is expanded and at the same time heat energy is converted to mechanical energy. However, the roots blower as a low-pressure expansion device has the advantage according to the present invention that it can work with a lower gas friction and at the same time is unaffected by liquid droplets. The roots blower, at rotary speeds at which the sealing edge on the outer radius reaches velocities of more than about 1/10 of the speed of sound, achieves a particularly high volumetric efficiency since the gap acts as a dynamic seal at these velocities. The roots blower, which can be in the form of a lobed impeller pump, can work at its full efficiency with a pressure differential of 500 mbar and be used in a closed system at pressures of between 10 and 0.5 bar. Another advantage is that in the above expansion device only the pressure differential is essential for the efficiency rather than the mass or the expansion ratio. A full efficiency can be reached already with small pressure differentials of less than 2 bar. The physical reason lies in the long effective time of about 95% in the pump, since the process is not a conventional expansion in the sense of a compressor, but the expansion occurs by the gas exiting into the pressure joint. There is no inflow and outflow accompanied by an increase or a decrease of the suction volume in the roots blower, but the gas inflow is parallel to the transport of the gas via the rotary motion while the volume remains constant and thus with full efficiency. The roots blower and other comparable low-pressure expansion devices according to the present invention are advantageous with respect to other expansion devices in which the pressure variation occurs by changing the suction volume itself. As a result the effective time of that device is much shorter. During the expansion process the heat energy of the evaporated working fluid is at least partially converted to mechanical energy. Advantageously the roots blower is coupled to a generator for converting the mechanical energy to electric energy.

According to the present invention the expanded working fluid can be condensed in a heat exchanger. In another embodiment of the present invention at least part of the condensed working fluid, such as up to 16% of the mass percentage, can be injected into the roots blower during the expansion process wherein, according to the present invention, the injected working fluid partially condenses the vapor during heat exchange in the roots blower and therefore increases the effective pressure differential of the expansion. In a possible alternative, a separator, downstream of the heat exchanger, extracts part of the condensed working fluid for injection into the roots blower. Suitably, a pump, in turn downstream of the separator, recycles the condensed working fluid into the evaporator.

According to another embodiment of the invention, the injection is pressure-controlled in order to prevent any liquid damage from the impact of droplets on the fast rotating pistons.

Advantageously the method comprises a first component of the working fluid formed as a mixture which is absorbed in and/or downstream of the low-pressure expansion device by means of an absorption fluid; in the process heat is transferred to the remaining, evaporated second component, which is recyclable. In one embodiment of the invention, the mixture is azeotropic at a certain mixing ratio of the components with a minimum boiling point. Depending on the type of azeotropically evaporating mixtures with a minimum boiling point, the vaporization temperatures may be lowered so that they are below the condensation temperatures of the individual components. If the first component is adiabatically absorbed from the vapor mixture, the corresponding heat is transferred to the second component remaining evaporated. The withdrawal of the condensation heat can therefore be carried out at a higher temperature level. With suitably chosen azeotropic mixtures, in particular, the second evaporated component can be condensed in the evaporator of the working fluid itself while giving off the condensation heat so that the corresponding percentage of the heat energy can be recycled into the process. If the first component to be absorbed is water, for example, an alkaline silicate solution can be used as the absorption fluid.

In another embodiment, the working fluid, for example, an azeotropic mixture of water with perchloroethylene or silicone, can be evaporated, for example, by means of heat exchange with primary energy from process vapors or heated process liquids and/or heat stores. The absorption during which according to the present invention the absorption heat generated is transferred to the second component remaining evaporated, thereby heating this component to a temperature level above the boiling point of the azeotropic mixture, can be carried out in and/or downstream of the expansion device. One of the essential advantages is that by expanding the azeotropic mixture in the roots blower, mechanical energy can be "gained" and at the same time the expanded working fluid which has already "done work" in the expansion process is heated due to the absorption heat it generated during the separation (absorption) of the first from the second component. Herein the remaining working fluid can be recycled after expansion, for example, to give off its heat in the heat exchanger. In one embodiment of the present invention it is possible, for example, for the remaining working fluid (second component only) to be fed into the heat exchanger (evaporator) in which the remaining working fluid is condensed and, due to the condensation heat generated, the liquid working fluid is evaporated with the first and the second component and subsequently recycled into the expansion device. As a result, according to the present invention, the efficiency of the method for converting heat energy to mechanical energy can be substantially improved.

The working fluid is preferably formed by an azeotropic mixture with a minimum boiling point, or by a nearly azeotropic mixture. In the following the present invention will be described with reference to an azeotropic mixture, while the present invention can, of course, also relate to nearly azeotropic mixtures or non-azeotropic mixtures. High efficiencies can be achieved in particular with an azeotropic or near azeotropic mixture. Depending on the type of azeotropic mixture, evaporation temperatures can be lowered, so that they are below the evaporation temperatures of the individual components.

In a preferred embodiment the working fluid has a low volume-specific or low molar evaporation enthalpy. It is thus possible to achieve the generation of a great amount of drive vapor with a given amount of heat energy. Preferably the working fluid is a solvent mixture containing organic and/or inorganic solvent components. These can be, for example, mixtures of water and selected silicones. Preferably at least one component may be a protic solvent.

In an alternative embodiment the absorption fluid is a reversibly immobilizable solvent which, in the non-immobilized aggregate state, is the first component of the working fluid. The reversible solvent in the boiling working fluid can change advantageously by means of physico-chemical changes in such a way that it can be changed from the non-immobilized state to the reversibly immobilized state by ionizing or complex formation from the vapor phase, and can act as an absorption fluid for the working fluid in the non-immobilized form. This is how the evaporated working fluid already contains the absorption fluid (in the non-immobilized state) prior to expansion. The reversibly immobilized solvent is in an evaporated aggregate state and assumes the liquid state by physico-chemical changes, such as pH shift, change of mole fraction and the temperature in its volatility and/or in its vapor pressure (which can be compared to vapor as a solvent in its non-immobilized form and water as a reversibly immobilizable solvent). This is advantageous in that the working fluid consists of two components, wherein the one component in the reversibly immobilized state acts at the same time as an absorption fluid for the other component. Cyclic nitrogen compounds, such as pyridines, can be used, for example, as pH-dependent reversibly immobilizable solvents.

The object of the invention is also met by an expansion device for converting heat energy to mechanical energy by expanding an evaporated working fluid wherein the expansion device is a low-pressure expansion device designed as a roots blower.

According to the present invention it is provided that the expansion device is a low-pressure expansion device, here formed as a roots blower. Herein two rotators run in mesh with each other on elliptical or oval shaped rolling curves. Prior art examples are the lobed impeller pump or the roots blower. Higher-order elliptical rolling curves can be realized by means of multi-blade rotors. An advantage of roots blowers having multi-blade rotors is, for example, that effective pulsations can be reduced, since the chamber volume is smaller with respect to the suction volume and the frequency of the gas ejection is increased. Suitably, the roots blower has a gas-tight seal between the suction chamber and the drive chamber in order to prevent oil from being introduced into the evaporated working fluid. The roots blower also has a shaft that can be coupled with a generator wherein the mechanical energy can be converted to electric energy. The use of a roots blower as a low-pressure expansion device makes it possible, in particular when using waste heat having a temperature of less than about 100° C., for driving for example pumps or generators, on the one hand to contribute to the process by injecting absorption fluids and on the other hand, due to the low pressure and temperature differentials, to increase the condensation energy of the working fluid, such as by means of a heat pump, back to a higher temperature level.

Further advantages, features and details of the present invention can be derived from the following description in which an advantageous embodiment of the present invention is described in detail with reference to the accompanying drawing. The features mentioned in the claims and in the description can be essential for the present invention singly or in any combination.

DETAILED DESCRIPTION OF THE PREFERRED EMBODIMENTS

Figure 1:
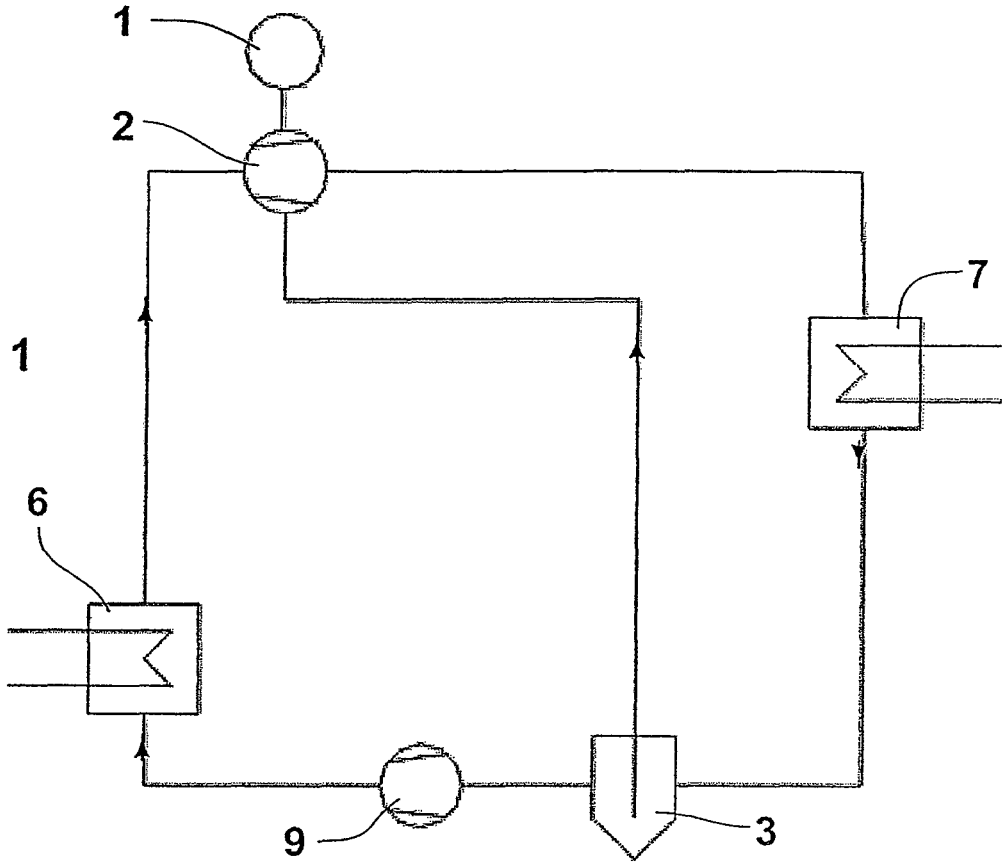
FIG. 1 is a schematic diagram showing a system for performing the method according to the present invention.
Figure 2:
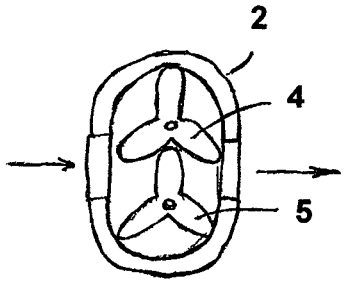
FIG. 2 is a schematic diagram of a roots blower with multi-blade rotors.

FIG. 1 shows a method for converting heat energy generated in an evaporator 6 to mechanical energy by expanding an evaporated working fluid which is evaporated in evaporator 6 and expanded in a low-pressure expansion device 2. The working fluid in the present embodiment is water which is fed to expansion device 2 which is formed as a roots blower 2 in its evaporated aggregate state. During the expansion process the heat energy contained in the working fluid is converted to mechanical energy in roots blower 2. Roots blower 2 is coupled to a generator 1 and drives it, thereby converting mechanical energy to electric energy. The roots blower 2 may, for example, have multi-blade rotors 4,5 as shown in FIG. 2.

The expanded driving vapor is condensed in a heat exchanger 7. Preferably evaporator 6 is connected to heat exchanger 7, wherein the condensate is recycled into evaporator 6 by means of a pump 9.

A separator 3 is arranged downstream of the heat exchanger 7 and extracts part of the condensed working fluid for injection into roots blower 2. Roots blower 2 has a plurality of injection openings (not shown) through which the condensed working fluid is injected into the suction chamber of roots blower 2, wherein part of the evaporated working fluid is condensed in roots blower 2, whereby the output pressure is reduced and therefore the efficiency is improved. Due to the pressure differential with respect to heat exchanger 7 coupled to the outlet of roots blower 2, the rotors arranged in roots blower 2 are driven by the working fluid being expanded, and the change in entropy accompanying the expansion is given off as mechanical energy. A pump 9 is downstream of separator 3, which recycles the condensed working fluid into evaporator 6.

What is claimed is:

1. A method of converting heat energy generated in an evaporator to mechanical energy by expanding an evaporated working fluid comprising the steps of:

evaporating a working fluid in the evaporator;

expanding the evaporated working fluid in a low-pressure expansion device, wherein the low-pressure expansion device is a roots blower having a triple blade rotors, the roots blower including an intake and a suction chamber and being arranged and dimensioned so that the working fluid is expanded therein and heat energy is transformed to mechanical energy; and condensing the expanded working fluid in a heat exchanger and injecting at least a portion of the condensed working fluid into the suction chamber of the roots blower during the expansion of further working fluid.

2. The method of claim 1, wherein at least a portion of the injected working fluid condenses a portion of the evaporated working fluid in the roots blower due to heat exchange, thereby reducing an output pressure of the roots blower.

3. The method of claim 1, wherein the injected working fluid is pressure-controlled during said step of injecting.

4. The method of claim 1, further comprising the step of feeding the condensed working fluid into the evaporator using a pump.

5. The method of claim 1, further comprising the step of extracting a portion of the condensed working fluid for injection into the roots blower using a separator arranged downstream of the heat exchanger.

6. The method of claim 1, wherein the working fluid is a mixture including first and second components, the method further comprising absorbing, by an absorption fluid, the first component of the working fluid in or downstream of the low-pressure expansion device, and transferring heat to the second component during said step of absorbing, the heat being recyclable.

7. The method of claim 6, wherein the mixture forms an azeotropic mixture having a minimum boiling point at a certain mixing ratio of the components.

8. The method of claim 6, wherein the working fluid is an azeotropic mixture or a nearly azeotropic mixture.

9. The method of claim 6, wherein the heat transferred during absorption heats the second component to a temperature above the boiling point of the mixture, and wherein the second component is condensed in a heat exchanger.

10. The method of claim 6, wherein the absorption fluid is a reversibly immobilizable solvent which, in a non-immobilized aggregate state, is the first component of the working fluid.

11. The method of claim 1, wherein the working fluid is an azeotropic mixture of water and silicone.

12. The method of claim 6, wherein the absorption fluid is a silicate solution.

13. The method of claim 1, wherein the intake receives the evaporated working fluid, the roots blower further including an output through which the expanded working fluid exits the roots blower and a plurality of injection openings through which the at least the portion of the condensed working fluid is injected into the suction chamber of the roots blower.

14. An expansion device for converting heat energy to mechanical energy by expanding an evaporated working fluid received from an evaporator, said expansion device comprising:

a low-pressure expansion device configured as a roots blower having triple blade rotors, the roots blower including an intake, a suction chamber and at least one injection opening, and arranged and dimensioned for expanding an evaporated working fluid received from the evaporator and thereby converting heat energy to mechanical energy; and a heat exchanger configured to condense the expanded working fluid and to inject at least a portion of condensed working fluid into the suction chamber of the roots blower during the expansion of further working fluid.

15. The expansion device of claim 14, further comprising a generator coupled to said roots blower.

16. A system for converting heat energy to mechanical energy by expanding an evaporated working fluid, comprising:

an evaporator evaporating a working fluid;

an expansion device comprising a roots blower having triple blade rotors, the roots blower including an intake, a suction chamber and at least one injection opening connected for receiving the evaporated working fluid from said evaporator, said expansion device expanding the evaporated working fluid and converting heat energy generated in the evaporator to mechanical energy; and a heat exchanger configured to condense the expanded working fluid and to inject at least a portion of condensed working fluid into the suction chamber of the roots blower during the expansion of further working fluid.

17. The expansion device of claim 14, wherein the intake receives the evaporated working fluid, the roots blower further including an output through which the expanded working fluid exits the roots blower, and wherein the at least one injection opening includes a plurality of injection openings through which the at least the portion of the condensed working fluid is injected into the suction chamber of the roots blower.

18. The system of claim 16, wherein the intake receives the evaporated working fluid, the roots blower further including an output through which the expanded working fluid exits the roots blower, and wherein the at least one injection opening includes a plurality of injection openings through which the at least the portion of the condensed working fluid is injected into the suction chamber of the roots blower.

* * * * *